US006653262B2

(12) United States Patent
Smith et al.

(10) Patent No.: US 6,653,262 B2
(45) Date of Patent: Nov. 25, 2003

(54) DUST FREE LITHIUM HYDROXIDE

(75) Inventors: W. Novis Smith, Philadelphia, PA (US); Joel McCloskey, Philadelphia, PA (US); Andrew Atterbury, Anaheim, CA (US)

(73) Assignee: Toxco, Inc., Anaheim, CA (US)

( * ) Notice: Subject to any disclaimer, the term of this patent is extended or adjusted under 35 U.S.C. 154(b) by 0 days.

(21) Appl. No.: 10/033,456

(22) Filed: Dec. 27, 2001

(65) Prior Publication Data

US 2003/0125217 A1 Jul. 3, 2003

(51) Int. Cl.[7] ..... C10M 113/16; C10M 125/10
(52) U.S. Cl. ..... 508/154; 508/178
(58) Field of Search ..... 508/154, 178

(56) References Cited

U.S. PATENT DOCUMENTS 2,532,201 A * 11/1950 Sprague ..... 117/100
2,639,221 A * 5/1953 Henn ..... 23/184
2,649,376 A * 8/1953 Rasch et al. ..... 95/88
2,755,247 A * 7/1956 Dilworth et al. ..... 252/33.3
2,846,308 A * 8/1958 Baxendale ..... 96/66
2,883,342 A * 4/1959 Sproule et al. ..... 252/42.1
2,967,826 A * 1/1961 Dilworth et al. ..... 252/18
2,983,680 A * 5/1961 Eckert et al. ..... 252/42.1
3,388,065 A * 6/1968 Haimbaugh ..... 252/42.1
5,948,736 A * 9/1999 Smith et al. ..... 508/178
6,153,563 A * 11/2000 Smith et al. ..... 508/154

* cited by examiner

*Primary Examiner*—Ellen M. McAvoy
(74) *Attorney, Agent, or Firm*—John Lezdey

(57) ABSTRACT

The present invention provides a method for forming dust free lithium hydroxide monohydrate. The method contains the step of coating the lithium hydroxide with 0.2 to 1.5% by weight of paraffinic oils.

12 Claims, No Drawings

DUST FREE LITHIUM HYDROXIDE

FIELD OF THE INVENTION

The present invention relates to the preparation of lithium hydroxide which is substantially dust free. More particularly, there is provided coated lithium hydroxide monohydrate crystals which are dust free and suitable for producing industrial grease.

BACKGROUND OF THE INVENTION

Lithium hydroxide monohydrate produces a small amount of dust which is always present when being handled or poured. This dust is extremely choking and irritating to humans even in trace amounts. Large amounts of lithium hydroxide monohydrate are used in industrial grease manufacturing and the choking dust has been a major problem in its use.

Lithium hydroxide has also been used in closed-cycle oxygen systems such as the atmosphere which is found in closed places as submarines or in re-breathing appliances which are used in anesthesia or emergency oxygen equipment because it will react with carbon dioxide. In a rebreather system is it necessary that the carbon dioxide be 4% or less than the entire atmosphere in as much as a greater amount of carbon dioxide will result in a deleterious effect upon the person in the breathing apparatus. The use of lithium hydroxide has been complicated by the fact that anhydrous lithium hydroxide pellets tend to crumble and create noxious dust.

U.S. Pat. No. 3,607,040 to Hevert et al has solved the problem of preventing the crumbling and dust formation of pellets by treating anhydrous lithium hydroxide with polyvinyl alcohol and then calcining the resultant mixture to remove any water. The problem with the use of polyvinyl alcohol is that a unitary treatment of lithium hydroxide is not possible for both powder and pellets since polyvinyl alcohol is not used in the production of grease.

U.S. Pat. No. 2,629,652 to Schecter et al discloses forming porous, anhydrous, non-dusting granules of lithium hydroxide for use in closed space ventilation systems by pressing lithium hydroxide having a water content of between 40 and 45% under pressure of 18,000 to about 25,000 psi to form a cake, breaking the cake into granules and then heating the granules to a moderate elevated temperature. The dust problem is solved because the fine particles which cause dust are physically separated from the granules.

U.S. Pat. No. 2,846,308 to Baxendale disclosed the treatment of alkali hydroxides, which includes lithium hydroxide, with an ester or an organic acid or an ester or an inorganic acid in liquid form to reduce the hydroscopic properties of the alkali hydroxide for use as photographic developers. About 1 to 15% by weight of a lower alkyl acid ester which is liquid and can generate a volatile alcohol is utilized.

U.S. Pat. No. 5,948,736 to Smith et al discloses the coating of lithium monohydrate crystals with fatty acids, esters or triglycerides thereof which require heating to properly coat.

It is an object of the invention to provide a method for reducing the dust when handling lithium hydroxide monohydrate powders and granules without heating.

It is another object of the invention to provide a pourable dust-free lithium hydroxide monohydrate powder.

It is yet another object of the invention to provide a pourable lithium hydroxide monohydrate powder which can be directly utilized to produce an industrial grease.

SUMMARY OF THE INVENTION

In accordance with the present invention the above and other objects are accomplished by coating the surface of lithium hydroxide particles and granules with about 0.2 to 1.5% by weight of paraffinic oil, particularly a saturated hydrocarbon oil or a saturate napthenic oil.

Fumed silica in an amount of about 0.01 to 1% weight percent may be added to the composition to enhance flowability.

DESCRIPTION OF THE PREFERRED EMBODIMENTS

In one aspect an embodiment of the present invention lithium monohydrate can be made substantially dust free and pourable by the method of adding about 0.2 to 1.5% by weight of a coating of paraffinic oil.

Prefereably, the coating is formed by admixing the lithium hydroxide at ambient temperatures. The paraffinic oils which may be used are those which have a starting boiling point of at least 150° C. and a primary boiling point of over about 200° C. The paraffin oils are the saturated hydrocarbon oils and saturated napthenic oils including mineral oils of different viscosities.

The paraffinic oils have the advantage over prior coating compositions because they tend to spread evenly at ambient temperatures and do not require heat and subsequent cooling.

These oils are similar and with the base stock oils which are used to make the grease. The coating composition can be applied to the particles in any suitable manner such as by dusting, spraying, grinding or dipping. The coating composition can be mixed with the lithium hydroxide in a tumbler, mixer or other similar apparatus. A solid coating agent may also be dissolved in a suitable solvent sprayed over the lithium hydroxide particles and the solvent then removed in a conventional manner.

In accordance with another embodiment of the invention 0.01 to 1% by weight of composition of fumed silica can be added to improve pourability.

The following examples are illustrative of the practice of the method of the present invention. It will be understood, however, that it is not to be construed as in any way limitative of the full scope of the invention since various changes can be made, without departing from the spirit of the teaching contained herein, in the light of the guiding principles which have been set forth above. All percentages herein stated are based on weight except where noted.

EXAMPLE 1

100 lbs. of lithium hydroxide monohydrate were tumbled in a closed mixer and 0.7 lbs. of a white mineral oil (paraffin oil boiling point greater than 230° C.) was sprayed on it as it was tumbled. The material was bagged and sealed. When the bag was reopened and the contents poured out, no choking sensation was noted which would definitely have occurred if the mineral oil coating had not been applied.

Comparative Example 1

100 lbs. of lithium hydroxide monohydrate were tumbled in a closed mixer and 1.8 lbs. of a white mineral oil (paraffin oil boiling point greater than 230° C.) was sprayed on it as it was tumbled. The material was bagged and sealed. When the bag was reopened and the contents poured out, no choking sensation was noted which would definitely have occurred if the mineral oil coating had not been applied. Although the material poured out of the bag satisfactorily, it was caking and somewhat lumpy due to the extra oil.

EXAMPLE II 100 lbs. of lithium hydroxide monohydrate were tumbled in a closed mixer and 0.5 lbs. of a light mineral oil (paraffin oil boiling point greater than 230° C.) was sprayed on it as it was tumbled. The material was bagged and sealed. When the bag was reopened and the contents poured out, no choking sensation was noted which would definitely have occurred if the mineral oil coating had not been applied. If desired, about 0.1 to 1% by weight of fumed silica may be added.

EXAMPLE III

Preparation of Lithium Grease 5 grams of coated dust free lithium hydroxide from Example 1 was added to about 50 grams of water to make up a solution of lithium hydroxide. This solution was added slowly to a stirred mixture of 33.6 grams Cenwax A and Jesco 750 Pale Oil heated at 95° F. over 2 hr. The water was allowed to escape without undue foaming. The solution was heated an additional hour to ensure full reaction. The grease mixture was heated to 150° and then cooled with stirring. The lubricant (grease) had a ½ scale 60 stroke penetration of 270 under the reaction displayed very little foaming and was easy to control.

In lieu of Cenwax A and Jesco 750 Pale Oil, other waxes and oils which are standard in the industry can be used.

What is claimed is:

1. A method of preparing non-dusting powders and granules of lithium hydroxide which comprises coating the lithium hydroxide powder or granules with about 0.2 to 1.5% by weight of paraffinic oil having a starting boiling point of at least 150° C.

2. The method of claim 1 wherein said lithium hydroxide is powdered lithium hydroxide monohydrate.

3. The method of claim 1 wherein said paraffinic oil is mineral oil.

4. The method of claim 1 wherein said paraffinic oil is napthenic oil.

5. The method of claim 1 where said coating composition is admixed with said lithium hydroxide at ambient temperatures.

6. The method of claim 1 which further includes the step of adding about 0.1 to 1% by weight of fumed silica.

7. A coated powder or granule of lithium hydroxide composition wherein said coating agent selected from the group consisting of mineral oil having a starting boiling point of at least 150° C.

8. The coated lithium hydroxide composition of claim 7, said lithium hydroxide is powdered lithium hydroxide monohydrate.

9. The coated lithium hydroxide monohydrate composition of claim 8 including 0.1 to 1% fumed silica.

10. A grease comprising the lithium hydroxide monohydrate composition of claim 7.

11. A grease comprising the composition of claim 9.

12. A coated lithium hydroxide powder produced by the process of claim 1.

* * * * *